US005090208A

United States Patent [19]

Aono et al.

[11] Patent Number: 5,090,208

[45] Date of Patent: Feb. 25, 1992

[54] REFRIGERATOR WITH AN AUTOMATIC ICE MAKER

[75] Inventors: Masao Aono, Mishima; Hiroshi Kanaoka, Suita, both of Japan

[73] Assignee: Kabushiki Kaisha Toshiba, Kawasaki, Japan

[21] Appl. No.: 601,389

[22] Filed: Oct. 23, 1990

[30] Foreign Application Priority Data

Oct. 24, 1989 [JP] Japan ..... 1-276399

[51] Int. Cl.[5] ..... F25C 1/12

[52] U.S. Cl. ..... 62/347

[58] Field of Search ..... 62/340, 347, 348

[56] References Cited

U.S. PATENT DOCUMENTS

| | | | |
|---|---|---|---|
| 3,274,792 | 9/1966 | Weil et al. | 62/347 X |
| 3,796,063 | 3/1974 | Wulke et al. | 62/340 |
| 3,969,909 | 7/1976 | Barto et al. | 62/340 x |
| 4,617,806 | 10/1986 | Sakai et al. | 62/347 |
| 4,903,505 | 2/1990 | Sakai et al. | 62/347 |
| 4,909,039 | 3/1990 | Yamada et al. | 62/66 |
| 4,934,159 | 6/1990 | Sakai et al. | 62/347 |

FOREIGN PATENT DOCUMENTS 51-66862 5/1976 Japan .

*Primary Examiner*—William E. Tapolcai
*Attorney, Agent, or Firm*—Cushman, Darby & Cushman

[57] ABSTRACT

An ice maker equipped in a refrigerator includes an sealed water tank, a water reservoir supplied with water from the water reservoir by the effect of a difference between water heads until the water reaches a predetermined water level, every time the level of the water reserved therein is decreased below the predetermined water level, a measuring vessel communicated to the water reservoir through a relatively small water path so that the water is supplied thereto from the water vessel by way of the difference in the water heads until the water level corresponding to the water level in the water reservoir is reached therein, the measuring vessel having a lid portion disposed so as to horizontally partition the interior of the measuring vessel at a water level position, an ice tray disposed in the ice-making compartment, and a pump for supplying the ice tray with the water reserved in the measuring vessel.

3 Claims, 4 Drawing Sheets

REFRIGERATOR WITH AN AUTOMATIC ICE MAKER

BACKGROUND OF THE INVENTION

This invention relates to a refrigerator having an ice maker wherein an amount of water supplied from a water tank to a measuring vessel is further supplied to an ice tray by a pump and the water in the tray is made into ice.

A predetermined amount of water is supplied to an ice tray in conventional refrigerators provided with an automatic ice making function. In one of arrangements for such an ice making function, a water reservoir is supplied with water from a sealed water tank through a water outlet thereof by the effect of a difference between water heads. With decrease in the water level in the water reservoir, the water supply to the reservoir is automatically performed so that the water is maintained at a selected level in the water reservoir, which level corresponds approximately to the position of the water outlet of the water tank. Behind the water reservoir is provided a measuring vessel into which water flows through a slit so that the water level in the water reservoir is maintained at that in the measuring vessel. An amount of water reserved in the measuring vessel is maintained at a predetermined value by previously setting dimensions of the vessel. A pump is operated to feed the water reserved in the measuring vessel to an ice tray. The pump is stopped when it begins to suck air because of decrease in the water level, so that the amount of water fed into the ice tray is fixed at a predetermined amount. Since a small amount of water is automatically supplied to the measuring vessel through the slit even during the operation of the pump, that amount of water is taken into consideration in determining the size of the measuring vessel.

In accordance with the above-described arrangement, the water level in the water reservoir is unchanged when the water reservoir and the measuring vessel are inclined rearward after assembly or when the refrigerator is arranged in an inclined state even if the water reservoir and the measuring vessel are properly assembled, but the water level in the measuring vessel positioned behind the water reservoir exceeds the predetermined level. As a result, an excessive amount of water is supplied to ice tray and the water level in the ice tray exceeds partition walls disposed in the ice tray so that a number of ice cubes are provided. When the ice is made in the ice tray over-fed with the water, a plate-like ice is made at the upper portions of the partition walls, which ice is difficult to be removed from the walls. When such an ice is removed from the ice tray, the ice cubes become uneven in size and a part of the ice is not removed from the ice tray to be left therein.

SUMMARY OF THE INVENTION

Therefore, an object of the present invention is to provide a refrigerator having an ice maker wherein when the water path from the water tank to the measuring vessel is assembled to be inclined or when the refrigerator is arranged in the inclined state, the water supplied into the measuring vessel can be maintained at a predetermined level, the water supplied into the ice tray is always maintained at a predetermined amount to obtain ice cubes which are the same in size, and the ice can be reliably removed from the ice tray.

The present invention provides a refrigerator equipped with an ice maker and having at least an ice making compartment provided therein, the ice maker comprising a water tank, a measuring vessel supplied with water from the water tank through water path means for feeding the water by the effect of a difference between water heads, the measuring vessel having a lid portion regulating an increase in the water level therein to a predetermined value when the water is supplied thereto from the water tank, an ice tray disposed in the ice making compartment, and pump means for supplying the ice tray with the water reserved in the measuring vessel.

In accordance with the above-described refrigerator, the amount of water to be supplied into the ice tray corresponds to that of the water fed into the measuring vessel from the water tank through a water path by the effect of the difference in the water heads. Since the maximum water level in the measuring vessel is regulated by the lid portion thereof, the amount of water in the measuring vessel is not varied even when the disposition of the refrigerator with an inclination or an error in the assembly inclines the water path between the water tank and the measuring vessel, resulting in the difference in the water heads. Consequently, the ice tray can be prevented from being supplied with water in excess owing to the inclination of the water path.

The invention may also be practiced as a refrigerator equipped with an ice maker and having at least an ice making compartment provided therein, the ice maker comprising an sealed water tank, a water reservoir supplied with water from the water tank by the effect of a difference between water heads until the water reaches a predetermined water level, every time the level of the water reserved therein is decreased below the predetermined water level, a measuring vessel communicated to the water reservoir through a relatively small water path so that the water is supplied thereto from the water reservoir by the effect of the difference in the water heads until the water level corresponding to the water level in the water reservoir is reached in the measuring vessel, the measuring vessel having a lid portion disposed so as to horizontally partition the interior of the measuring vessel at a water level position, an ice tray disposed in the ice-making compartment, and pump means for supplying the ice tray with the water reserved in the measuring vessel.

Other objects of the invention will become obvious upon understanding of an illustrative embodiment about to be described or will be indicated in the appended claims. Various advantages not referred to herein will occur to one skilled in the art upon employment of the invention in practice.

DESCRIPTION OF THE PREFERRED EMBODIMENT

Two embodiments of the present invention will be described with reference to the accompanying drawings.

Figure 1:
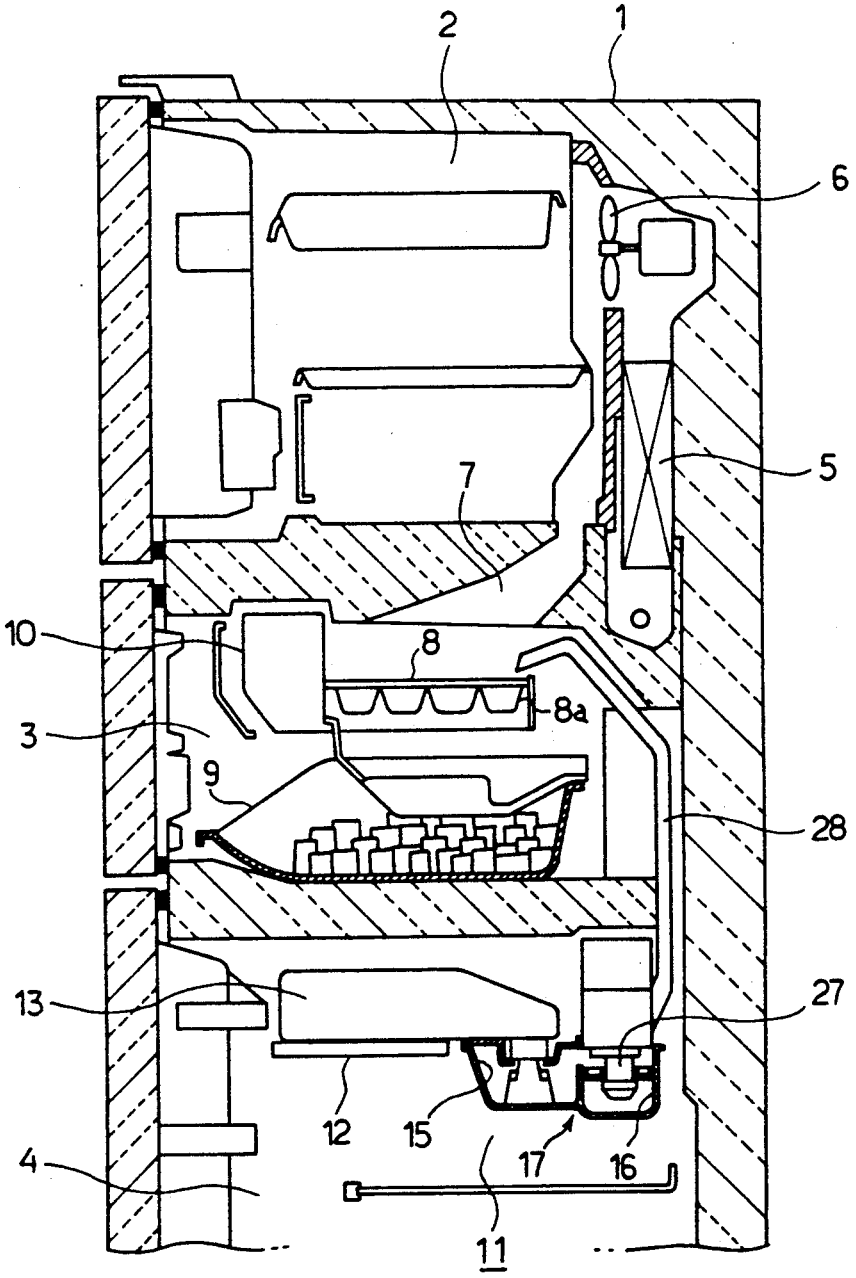
FIG. 1 is a partially longitudinal sectional view of a refrigerator in accordance with one embodiment of the invention.
Figure 6:
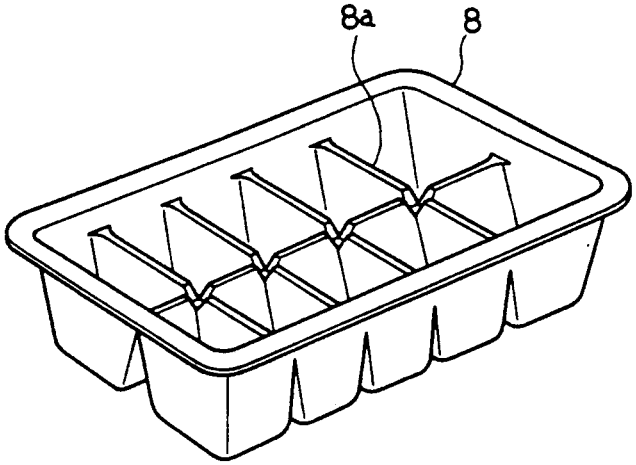
FIG. 6 is a perspective view of an ice tray employed in the refrigerator in FIG. 1.
Figure 7:
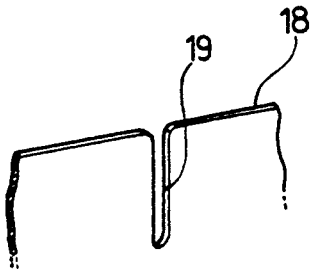
FIG. 7 is a perspective view of a water guide groove.

Referring first to FIG. 1, a body 1 of a refrigerator of a first embodiment has a freezing compartment 2, ice making compartment 3 and storage compartment 4 in order from the top. An evaporator 5 of a refrigerating cycle is provided at the back of the freezing compartment 2 and a chilled air circulating fan 6 is disposed above the evaporator 5. The chilled air delivered from the evaporator 5 is supplied to the freezing compartment 2 by the fan 6 and also to the ice making compartment 3 through a duct 7. Furthermore, the chilled air is circulated to the storage compartment 4 through another duct (not shown). An ice tray 8 is disposed in the upper interior of the ice making compartment 3 and an ice reservoir 9 is drawably disposed in the lower interior of the ice making compartment 3. As well known in the art, the ice tray 8 has partition walls 8*a* partitioning the interior of the ice tray 8 into a number of sections so that a number of ice cubes are made, as illustrated in FIG. 6. An ice remover 10 is provided for removing ice made in the ice tray 8 therefrom such that the ice cubes fall into the ice reservoir 9. An ice-making water supply mechanism 11 is provided in the upper interior of the storage compartment 4.

Figure 2:
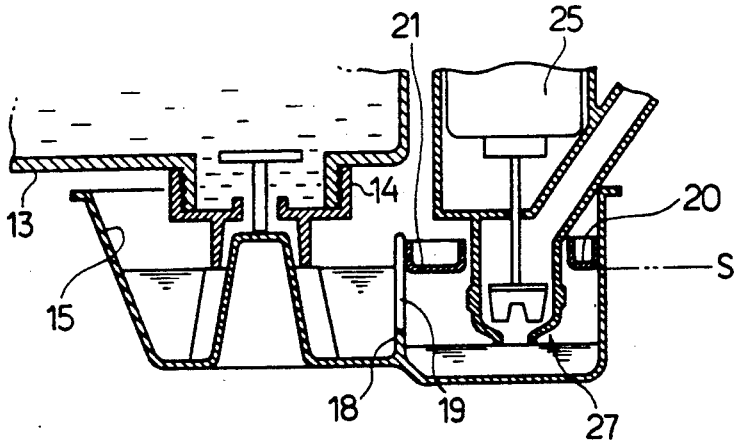
FIG. 2 is a partially sectional view of a water supply mechanism for supplying an ice tray with water in the refrigerator shown in FIG. 1.
Figure 5:
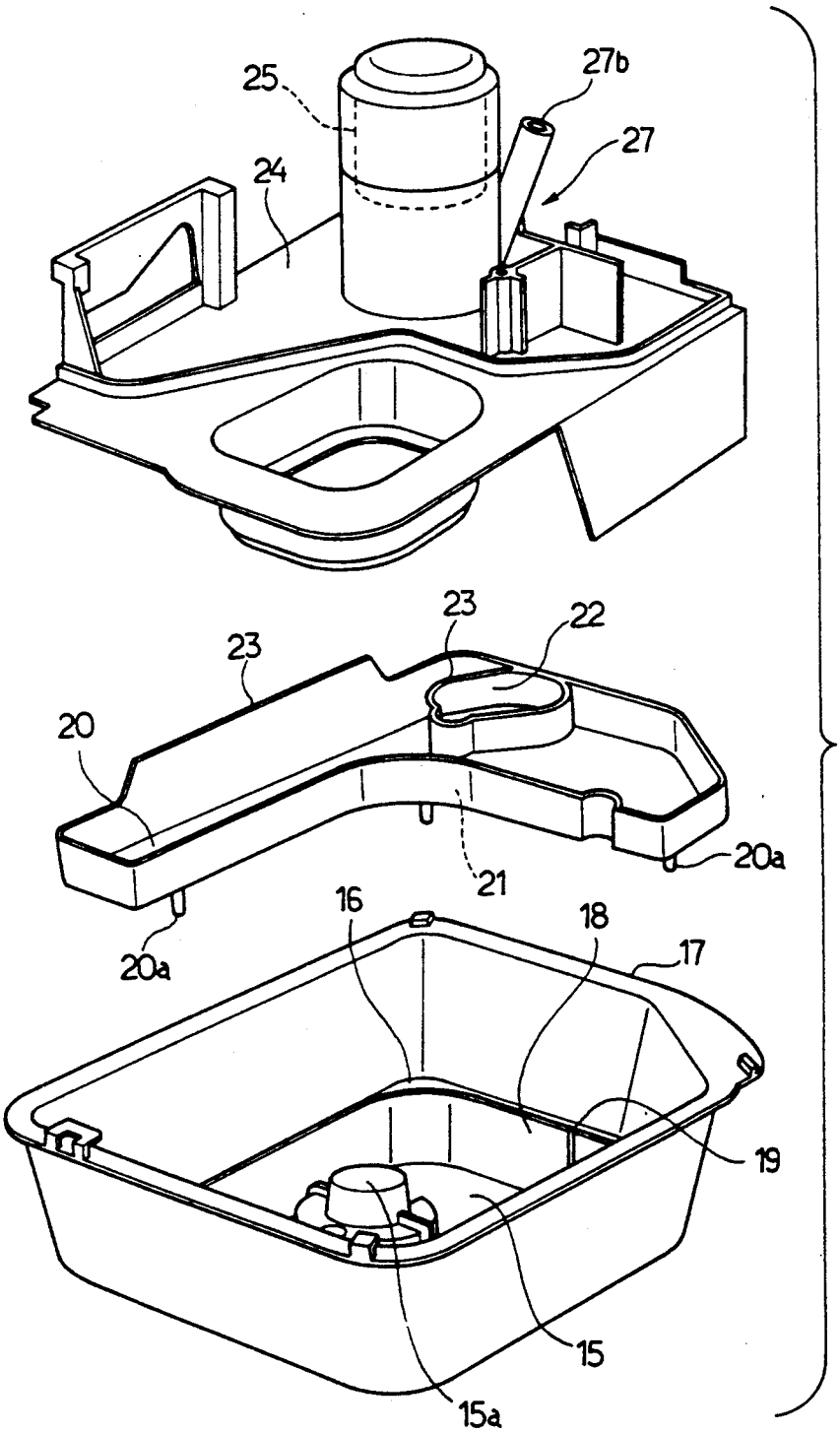
FIG. 5 is an exploded perspective view of the water supply mechanism.

The water supply mechanism 11 will now be described in detail with reference to FIGS. 1, 2 and 5. A sealed water tank 13 is drawably disposed on a shelf 12 and has an opening 13*a* formed at a rear lower portion thereof. A water outlet member 14 having a valve 14*a* is screwed to the opening 13*a*. A plastic receptacle assembly 17 comprising a water reservoir 15 and a measuring vessel 16 integral therewith is provided at the rear lower portion of the water tank 13. The water reservoir 15 has a convex portion 15*a* formed on the interior bottom thereof for pushing the valve 14*a* upward to thereby open the water outlet member 14*a*. A slit-like groove 19 is formed in a partition wall 18 partitioning the water reservoir 15 from the measuring vessel 16. The groove 19 serves as water path means for passing the water therethrough by the effect of the difference in the water heads and has a width of 1.5 millimeters. The measuring vessel 16 has a lid portion or lid member 20 horizontally partitioning the interior of the measuring vessel 16 at a set water level point and also leg portions 20*a* projected from the underside thereof. The leg portions 20*a* are caused to strike against the bottom of the measuring vessel 16 such that the gap between the lid member 20 and the bottom of the measuring vessel 16 is fixed and the underside surface of the lid member 20 corresponds to a predetermined water level S of the measuring vessel 16. The lid member 20 has an aperture 21 of a diameter of 1 to 3 millimeters at approximately the central portion thereof. The upper surface of the lid member 20 is gently inclined downwardly to the aperture 21. The lid member 20 has a through hole 22 through which a suction opening of a pump described below is passed. The lid member 20 also has an integral rise wall portion 23 rising upward over the periphery of the lid member 20 and the hole 22. The upper face of the receptacle assembly 17 is covered by an upper lid 24. A pump 27 having an impeller 26 rotated by an electric motor 25 is provided on the upper lid 24. The pump 27 is inserted into the inner bottom of the measuring vessel 16 through the hole 22 such that a suction opening 27*a* formed at the lower end of the pump 27 is away from the bottom of the measuring vessel 16 by a predetermined space. A water supply pipe 28 (see FIG. 1) connected to a discharge opening 27*b* of the pump 27 is upwardly extended so that water sucked by the pump 27 is supplied to the ice tray 8.

Figure 3:
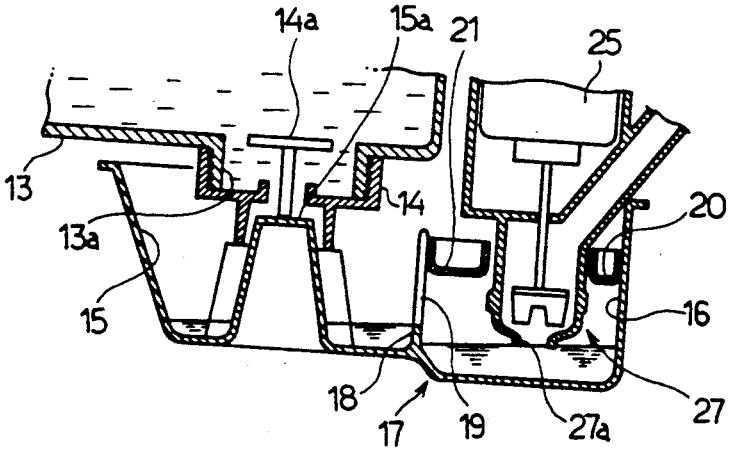
FIG. 3 is also a partially sectional view of the water supply mechanism showing another operational state.

The operation of the above-described construction will be described. When the water tank 13 filled with water is attached to the shelf 12, the valve 14*a* of the water outlet member 14 is opened and the water from the water outlet member 14 flows into the water reservoir 15 because of the difference in the water heads and then, is supplied into the measuring vessel 16 through the groove 19. The water level in the water reservoir 15 is raised such that the lower end of the water outlet member 14 is closed by the water. Consequently, since the air is prevented from entering the water tank 13, the water supply is stopped. The water level in the water reservoir 15 nearly corresponds to the lower end of the water outlet member 14. When the receptacle assembly 17 is properly maintained at a horizontal position, the water level of the above-described water reservoir 15 corresponds to the predetermined water level S of the measuring vessel 16. See FIG. 2. Upon the arrival of a predetermined timing of the above-noted ice making cycle, the pump 27 is driven for a selected period by the motor 25. The water reserved in the measuring vessel 16 is sucked into the pump 27 via the discharge and suction openings 27*b* and 27*a* by the rotation of the impeller 26 and then, is supplied to the ice tray 8 through the water supply pipe 28. When the water level in the measuring vessel 16 is decreased to the suction opening 27*a* as shown in FIG. 3, air is then sucked instead of the water, thereby terminating the water supply operation. In the case of the above-described water supply operation, an amount of water supplied to the ice tray 8 is the sum of an amount of water reserved between the water level S and the position of the suction opening 27*a* in the measuring vessel 16 and a small amount of water flowing into the measuring vessel 16 through the guide groove 19 during the suction operation of the pump 27. The cubic volume of the measuring vessel 16 is previously determined so that the above-mentioned summed amount of water corresponds to a proper amount of water to be supplied to the ice tray 8.

Figure 4:
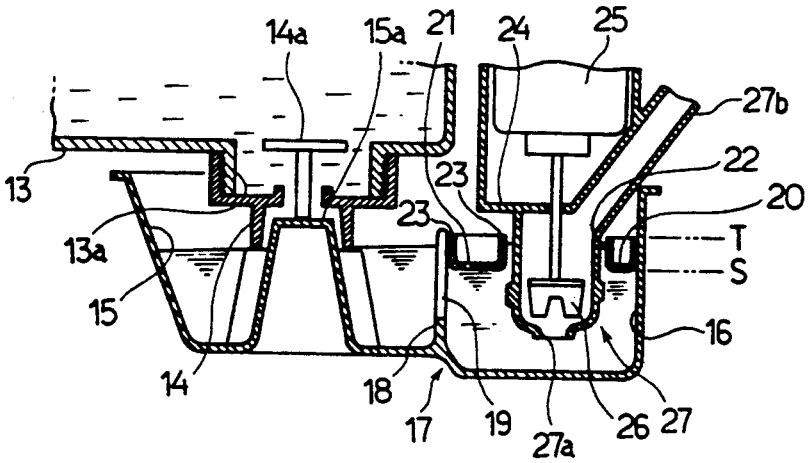
FIG. 4 is similar to FIG. 3 showing an abnormal state of the water supply mechanism.

On the other hand, when the receptacle assembly 17 happens to be assembled in the inclined state or when the refrigerator happens to be disposed so as to be inclined rearward, the receptacle assembly 17 is inclined such that the measuring vessel 16 is moved downward, as shown in FIG. 4. In this state, the water level in the rear portion of the water reservoir 15 is relatively increased to the level T as shown in FIG. 4 and in the absence of the lid member 20, the water level in the measuring vessel 16 would reach the level T in FIG. 4 and exceed the predetermined level S. However, in the present invention, the water level in the measuring vessel 16 is regulated by the lid member 20 so as not to exceed the predetermined level S. As a result, as in the case where the receptacle assembly 17 is disposed without any inclination, the pump 27 is operated to supply the ice tray with a proper amount of water.

In accordance with the above-described embodiment, even when the receptacle assembly 17 is assembled in the inclined state or when the refrigerator is disposed so as to be inclined rearward, the amount of water supplied to the ice tray 8 is fixed. Accordingly, since the water level in the ice tray 8 is prevented from increasing in excess of the sections partitioned by the partition walls 8*a*, the part of water in excess of the sections is prevented from being made into a plate-shaped ice which is difficult to be removed at the partition walls 8*a* in the ice removing operation. Consequently, the ice cubes of the uniform size can be made and the ice removing operation can be performed reliably.

Since the lid member 20 is provided with the opening 21, the water reserved on the upper side of the lid member 20 for some reason can be prevented from being left thereon for a long period to thereby be spoilt. More specifically, when the water level in the measuring vessel 16 is decreased after the start of operation of the pump 27, the water left on the lid member 20 flows into the measuring vessel 16 through the opening 21. As a result, the water can be prevented from being reserved on the upper face of the lid member 10. In the above-described embodiment, the dimension of the aperture 20 has a diameter of 1 to 3 millimeters (0.78 to 7.06 square millimeters). When the aperture 20 has the diameter below 1 millimeter, a surface tension of the water prevents the water from passing through the aperture 21. Further, when the aperture 20 has the diameter of 4 millimeters or above, the action of the surface tension of the water cannot be obtained in the measuring vessel 16 when it is filled with water. As a result, the water tends to pass through the aperture 21 to overflow the lid member 20. Therefore, the suitable diameter of the aperture 21 is in the range of 1 to 3 millimeters.

Figure 8:
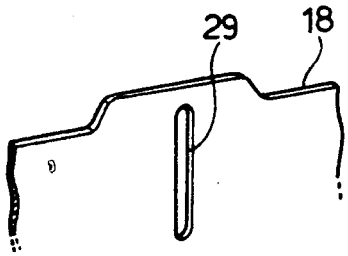
FIG. 8 is a view similar to FIG. 7 illustrating a modified form of the water guide groove.

A second embodiment of the invention will be described with reference to FIG. 8. A slit 29 not extended to the upper edge of the wall 18 and serving as a guide groove is formed in the partition wall 18 of the receptacle assembly 17, instead of the groove 19. In the case of the slit 29, the deviation of the width thereof can be reduced at the time of the formation from a plastic material and owing to the aged changes. Accordingly, the amount of water flowing into the measuring vessel 16 from the water reservoir 15 during the operation of the pump 27 can be determined with more reliability than in the previous embodiment and therefore, the amount of water supplied to the ice tray 8 can be determined with more reliability.

The foregoing disclosure and drawings are merely illustrative of the principles of the present invention and are not to be interpreted in a limiting sense. The only limitation is to be determined from the scope of the appended claims.

We claim:

1. a refrigerator equipped with an ice maker and having at least one ice making compartment provided therein, the ice maker comprising:

a) an enclosed water tank;

b) a water reservoir supplied with water from the water tank by the effect of a difference between water heads, until the water reaches a predetermined water level, water being so supplied every time the level of the water reserved therein is decreased below the predetermined water level;

c) a measuring vessel communicated to the water reservoir through a relatively small water path so that the water is supplied thereto from the water reservoir by the effect of the difference in the water heads, until the water level corresponding to the water level in the water reservoir is reached therein, the measuring vessel having a lid portion disposed so as to horizontally partition the interior of the measuring vessel at a water level position;

d) an ice tray disposed in the ice making compartment; and e) pump means for supplying the ice tray with the water reserved in the measuring vessel.

2. A refrigerator according to claim 1, wherein the lid portion of the measuring vessel has an aperture communicated to the measuring vessel and the aperture has a sectional area in the range between approximately 0.78 and 7.068 square millimeters.

3. The refrigerator according to claim 1, wherein the water path comprises a vertically slender slit.

* * * * *